US010006686B2

(12) United States Patent
Yang

(10) Patent No.: US 10,006,686 B2
(45) Date of Patent: Jun. 26, 2018

(54) REFRIGERATOR AND METHOD FOR MANUFACTURING THE SAME

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 163 days.

(21) Appl. No.: 14/841,432

(22) Filed: Aug. 31, 2015

(65) Prior Publication Data

US 2016/0370060 A1 Dec. 22, 2016

(30) Foreign Application Priority Data

Jun. 17, 2015 (KR) ..... 10-2015-0086084

(51) Int. Cl.
*F25C 1/22* (2018.01)
*F25C 1/04* (2018.01)
(Continued)

(52) U.S. Cl.
CPC ..... *F25C 1/04* (2013.01); *F25C 5/005* (2013.01); *F25D 11/022* (2013.01); *F25D 17/02* (2013.01); *F25D 23/006* (2013.01); *F25D 23/028* (2013.01); *F25D 23/04* (2013.01); *F25D 2400/14* (2013.01)

(58) Field of Classification Search
CPC .... F25D 2400/14; F25D 23/028; F25D 23/04; F25D 23/006; F25D 17/02; F25D 11/022; F25C 5/005; F25C 1/04; F25B 41/003; F16L 17/00
See application file for complete search history.

(56) References Cited

U.S. PATENT DOCUMENTS 9,115,924 B2 * 8/2015 Leclear ..... F25B 1/005
9,206,689 B2 12/2015 Lee
(Continued)

FOREIGN PATENT DOCUMENTS

CN 1719156 A 1/2006
CN 101446460 A * 6/2009
(Continued)

OTHER PUBLICATIONS

Extended European Search Report dated Nov. 7, 2016 issued in corresponding European Patent Application No. 15186865.0.
(Continued)

*Primary Examiner* — Len Tran
*Assistant Examiner* — Ana Vazquez

(57) ABSTRACT

A refrigerator includes a main body having a food storage space therein, a door installed on the main body and configured to have an ice compartment therein and to close the food storage space, a compressor, a condenser, and an expansion valve that are installed in the door, and an ice generator installed in the ice compartment. The ice generator includes a tray configured to receive and contain water therein, a refrigerant pipe line configured to connect the compressor, the condenser, and the expansion valve to each other and cool the tray by conduction, and one or more lock rings configured to connect in an airtight fashion the refrigerant pipe line to the compressor, the condenser, and the expansion valve.

12 Claims, 7 Drawing Sheets

(51) Int. Cl.

| | |
|---|---|
| ***F25C 5/00*** | (2018.01) |
| ***F25D 23/00*** | (2006.01) |
| ***F25D 23/02*** | (2006.01) |
| ***F25D 23/04*** | (2006.01) |
| ***F25D 11/02*** | (2006.01) |
| ***F25D 17/02*** | (2006.01) |

(56) References Cited

U.S. PATENT DOCUMENTS

| | | | | |
|---|---|---|---|---|
| 9,448,003 | B2 * | 9/2016 | Shin | F25C 1/24 |
| 2011/0162404 | A1 | 7/2011 | Shin et al. | |
| 2013/0167563 | A1 | 7/2013 | Lee et al. | |
| 2015/0137512 | A1 | 5/2015 | Kim | |

FOREIGN PATENT DOCUMENTS

| | | | |
|---|---|---|---|
| EP | 2320175 | A1 | 5/2011 |
| GB | 485045 | A | 5/1938 |
| JP | H08-086388 | A | 4/1996 |
| JP | H09-119762 | A | 5/1997 |
| KR | 10-2009-0012689 | A | 2/2009 |
| KR | 10-2009-0128123 | | 12/2009 |
| KR | 10-2012-0003233 | A | 1/2012 |
| KR | 10-2013-0048817 | A | 5/2013 |
| KR | 10-2015-0058820 | | 5/2015 |
| WO | 2009/017282 | A1 | 2/2009 |

OTHER PUBLICATIONS

European Office Action dated Oct. 17, 2017 issued in corresponding European Patent Application No. 15186865.0.

* cited by examiner

REFRIGERATOR AND METHOD FOR MANUFACTURING THE SAME

CROSS-REFERENCE TO RELATED APPLICATIONS

This application is based on and claims priority from Korean Patent Application No. 10-2015-0086084, filed on Jun. 17, 2015 for inventor Sung Jin Yang. The disclosure of this application is incorporated herein in its entirety by reference.

FIELD OF THE INVENTION

The present invention relates to a refrigerator and a method for manufacturing the refrigerator.

BACKGROUND OF THE INVENTION

As well known, refrigerators are apparatuses which store food at a temperature below the ambient temperature of the compartment. Refrigerators are configured to provide freezing storage or cold storage of food according to the kind of food.

The internal space of such a refrigerator is cooled by cold air that is continuously supplied thereinto. Cold air is continuously generated by heat exchange of refrigerant through a cooling cycle including compression, condensation, expansion, and evaporation. Cold air supplied into the refrigerator is uniformly applied to the internal space of the refrigerator by convection, whereby food in the refrigerator can be stored at a desired temperature.

Generally, a main body of the refrigerator has a rectangular parallelepiped structure that is open on a front surface thereof. A refrigerating compartment and a freezing compartment are provided in the main body. A refrigerating compartment door and a freezing compartment door are provided on the front surface of the main body so as to selectively open or close the opening of the refrigerator. A plurality of drawers, shelves, and storage boxes may be provided in the internal space formed in the refrigerator so that different kinds of foods can be stored under optimal conditions.

Conventionally, top mount refrigerators, in which a freezing compartment is disposed above a refrigerating compartment, have been mainly used. Recently, bottom-freezer refrigerators, in which a freezing compartment is disposed below a refrigerating compartment, were introduced to improve user convenience. The bottom-freezer refrigerators are advantageous in that users can more conveniently use the refrigerating compartment because the refrigerating compartment, which is comparatively frequently used, is disposed in an upper portion of the refrigerator, while the freezing compartment, which is used comparatively less than the refrigerating compartment, is disposed below the refrigerating compartment. However, the bottom-freezer refrigerators make a user bend over when drawing ice out of the freezing compartment because the freezing compartment is disposed in a lower portion of the refrigerator, thus inconveniencing the user.

In an effort to overcome the above problem, a bottom-freezer refrigerator in which an ice dispenser is provided in a door of a refrigerating compartment disposed in an upper portion of the refrigerator was recently proposed. In this case, an ice machine for producing ice may be provided in the refrigerating compartment door or the refrigerating compartment.

The ice machine may include an ice-making system which generates ice and is provided with an ice tray, an ice bucket which stores generated ice therein, and a transfer system transferring ice stored in the ice bucket to the dispenser.

Furthermore, an ice-making duct is installed to connect the freezing compartment with the ice machine. In detail, the ice-making duct is installed in a left or right sidewall of the refrigerating compartment such that an ice compartment connects with the freezing compartment through the ice-making duct when a door is closed.

Therefore, when the door opens, the ice-making duct is separated from the ice compartment. When the door is closed, the ice-making duct connects with the ice compartment so that cold air for generating ice can be supplied from the freezing compartment to the ice compartment through the ice-making duct.

However, the conventional refrigerator has the following problems.

First, the ice-making duct is installed in the left or right sidewall of the refrigerating compartment; thus, a separate structure for insulating the duct is required. Therefore, the internal capacity of the refrigerator is reduced, and the piping structure of the refrigerator is complex.

Second, only when the door is closed can cold air be transferred from the freezing compartment to the refrigerating compartment. When the door opens, cold air that passes through the ice-making duct is discharged out of the refrigerator. Therefore, the energy efficiency of the refrigerator is reduced.

Third, ice is produced by an indirect cooling method using cold air that is supplied from the ice-making duct. As such, since ice is not directly cooled, the time required to produce ice is increased.

SUMMARY OF THE INVENTION

In view of the above, embodiments the present invention provide a refrigerator which does not need a separate duct for transferring cold air for producing ice despite having a structure such that an ice generator is installed in a refrigerating compartment door. The structure of the refrigerator can be simple, and the internal capacity of the refrigerator is not diminished. Furthermore, the embodiments of the present invention provide a method for manufacturing the refrigerator.

Further, the embodiments of the present invention provide a refrigerator which is configured such that the ice compartment can be cooled regardless of whether the door is open or closed. The embodiments of the present invention also provide a method for manufacturing the refrigerator.

In addition, the embodiments of the present invention provide a refrigerator in which ice is generated by a direct cooling method in the ice compartment installed in the door, and a method for manufacturing the refrigerator.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Hereinafter, embodiments of the present invention will be described in detail with reference to the accompanying drawings which form a part hereof.

In describing the embodiments of the present invention, a detailed description of known functions or constructions related to the present invention will be omitted if it is deemed that such description would make the gist of the present invention unnecessarily vague.

Figure 1:
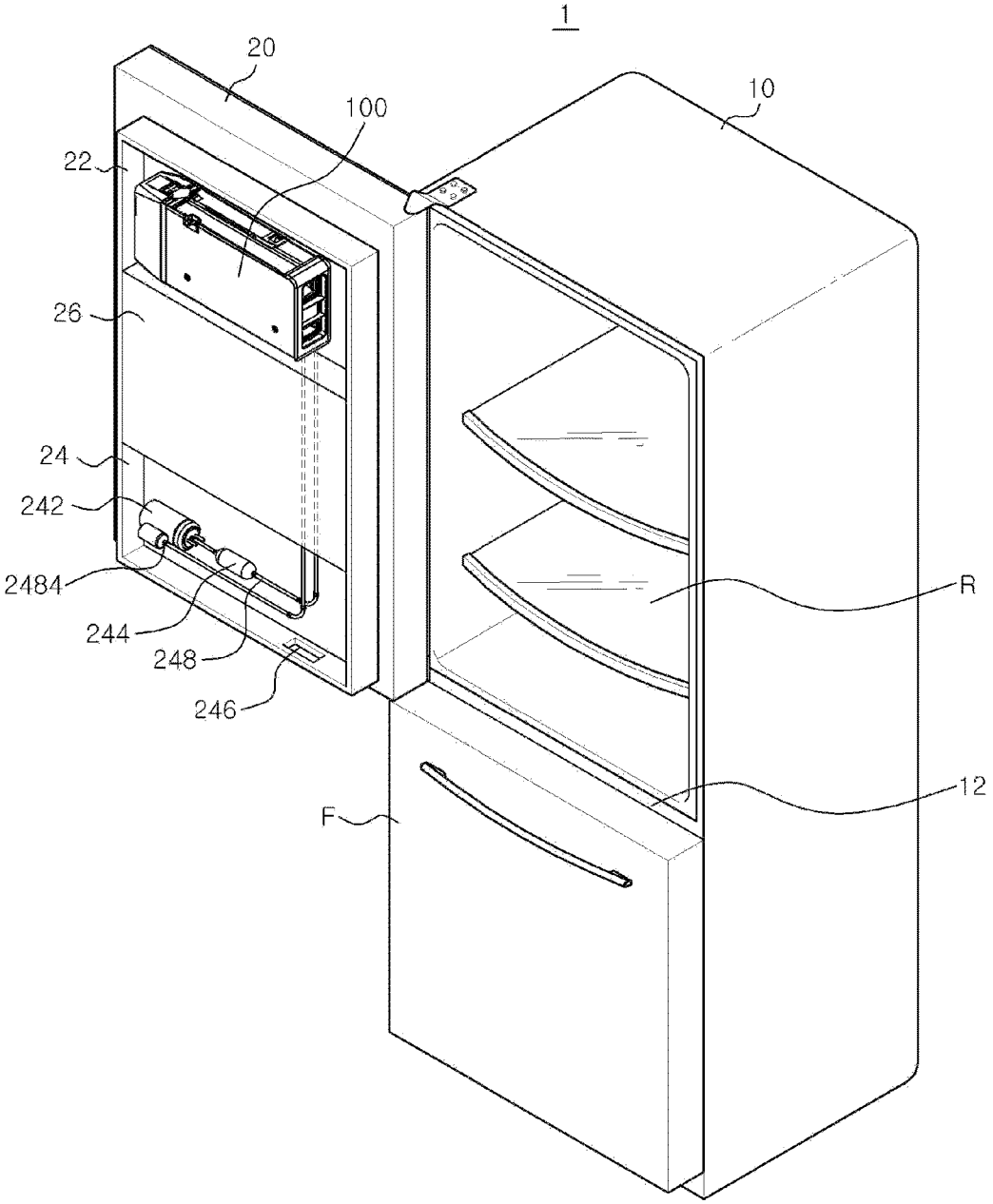
FIG. 1 is a perspective view showing the shape of a refrigerator when a door opens in accordance with an embodiment of the present invention.

FIG. 1 is a perspective view showing the shape of an exemplary refrigerator when a door opens in accordance with an embodiment of the present invention.

Referring to FIG. 1, a refrigerator 1 in accordance with an embodiment of the present invention includes a main body 10, a barrier 12, and a door 20. The main body 10 forms the general shape of the refrigerator 1 and stores food or the like therein. The barrier 12 partitions a food storage space defined in the main body 10 into an upper refrigerating compartment R and a lower freezing compartment F. The door 20 is provided on a front surface of the main body 10 and configured to swing so that the main body 10 can be selectively opened or closed by the door 20.

The door 20 includes an ice compartment 22, a machinery compartment 24, and an insulator 26. An ice generator 100, to generate ice, is installed in the ice compartment 22. The machinery compartment 24 includes a compressor 242 and a condenser 244. The insulator 26 is provided between the ice compartment 22 and the machinery compartment 24 and partitions the ice compartment 22 from the machinery compartment 24.

In the present embodiment, although the door 20 having the ice compartment 22 is illustrated as closing the refrigerating compartment R of the main body 10, this does not preclude embodiments where the ice compartment is formed in a door provided to selectively open or close the freezing compartment F.

Furthermore, in the present embodiments, although the structure in which the ice compartment 22 is formed in an upper portion of the door 20 and the machinery compartment 24 is formed in a lower portion of the door 20 is described for illustrative purpose, the spirit of the present invention is not limited to this configuration. For example, the ice compartment 22 may be formed in the lower portion of the door 20, and the machinery compartment 24 may be formed in the upper portion of the door 20.

The insulator 26 may be made of foamed material such as urethane foam and used to prevent heat exchange between the ice compartment 22 of a low temperature and the machinery compartment of a comparatively high temperature.

The door 20 includes a cover which closes a portion of the door 20 that faces the main body 10 so that even when the door 20 is open, the ice compartment 22 and machinery compartment 24 are not open to the outside. The cover functions to insulate an internal space of the door 20 from an internal space of the main body 10 when the door 20 is closed. For this, the cover may be made of a foamed membrane having an area corresponding to the entire area of the door 20. However, for the sake of explanation, illustration of the cover is omitted from FIG. 1.

Furthermore, an insulation membrane is provided on a perimeter of the door 20 to prevent cold air in the internal space of the door 20 from leaking out of the door 20.

The compressor 242 and the condenser 244 are provided in the machinery compartment 24 of the door 20. Furthermore, an expansion valve (not shown) of a cooling cycle may also be disposed in the machinery compartment 24. Alternatively, the expansion valve may be disposed in the insulator 26.

The compressor 242 may be a small-sized compressor, which is smaller than a typical compressor, provided in the main body of the refrigerator so that the compressor 242 can be installed in a small space in the door 20. A representative example of such a small-sized compressor was proposed in Korean Patent Unexamined Publication No. 10-2013-0048817.

The condenser 244 is connected to a rear end of the compressor 242 by a refrigerant pipe line 248. Gas-phased refrigerant compressed by the compressor 242 to high-temperature and high-pressure can be changed by the condenser 244 to a middle-temperature and high-pressure liquid-phased state. Further, the condenser 244 may also be a compact condenser so that it can be installed in the internal space of the door 20.

The compressor 242 and the condenser 244 are connected to a power supply (not shown) provided in the main body 10 so that power can be supplied to the compressor 242 and the condenser 244. Here, cables which connect the compressor 242 and the condenser 244 to the power supply of the main body 10 are disposed in a hinge pipe that forms a rotating shaft of the door 20.

A through hole 246, through which the machinery compartment 24 can communicate with the outside when the door 20 opens, is formed in a surface of the door 20 that forms the machinery compartment 24. When the door 20 opens, the outside air drawn into the machinery compartment 24 through the through hole 246 cools the condenser 244 such that the refrigerant in the condenser 244 can be condensed. For this, a hole (not shown) is formed in the surface of the condenser 244 to allow the outside air to be supplied into the condenser 244. A structure for heat exchange between the refrigerant and the outside air supplied through the hole is provided in the condenser 244.

The refrigerant pipe line 248 connects the compressor 242 to the condenser 244 and extends from a rear end of the condenser 244 to the ice compartment 22, disposed in the upper portion of the door 20, through the insulator 26. The refrigerant pipe line 248 is also connected to the ice generator 100 provided in the ice compartment 22.

The construction of the ice generator 100 installed in the ice compartment 22 will be described in detail with reference to FIGS. 2 to 4.

Figure 2:
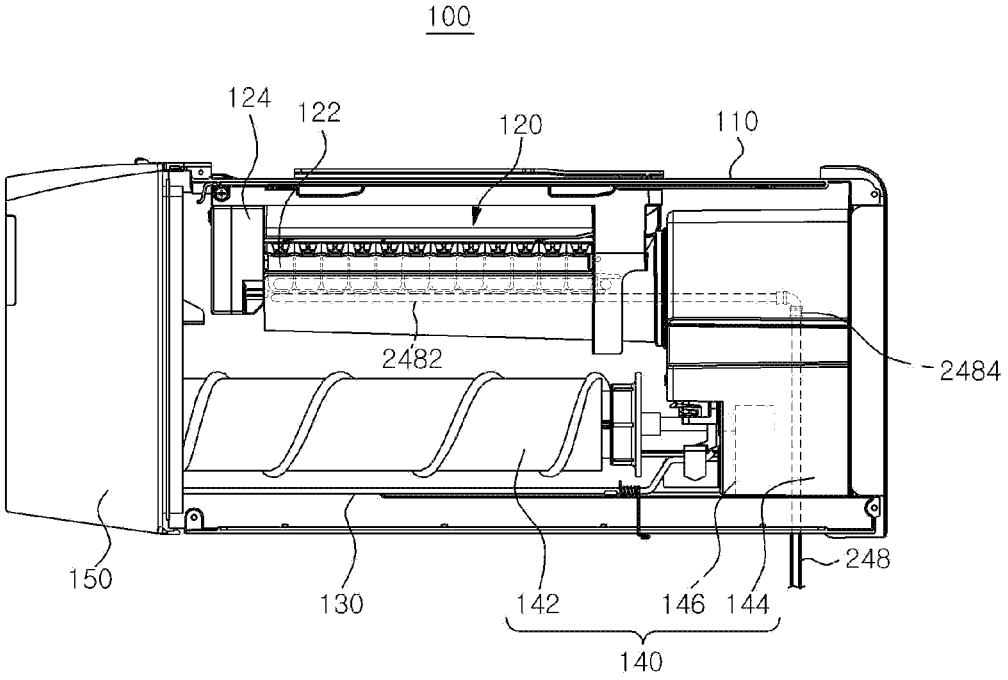
FIG. 2 is a front view illustrating an ice generator of FIG. 1.

FIG. 2 is a front view illustrating the ice generator of FIG. 1. FIG. 3 is a bottom view showing a tray and the refrigerant pipe line provided in the ice generator of FIG. 1. FIG. 4 is a sectional view showing a portion of the internal structure of the ice generator of FIG. 1.

Figure 3:
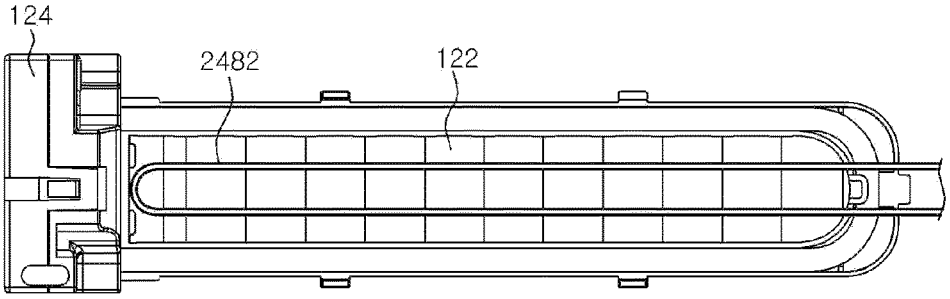
FIG. 3 is a bottom view showing a tray and a refrigerant pipe line provided in the ice generator of FIG. 1.
Figure 4:
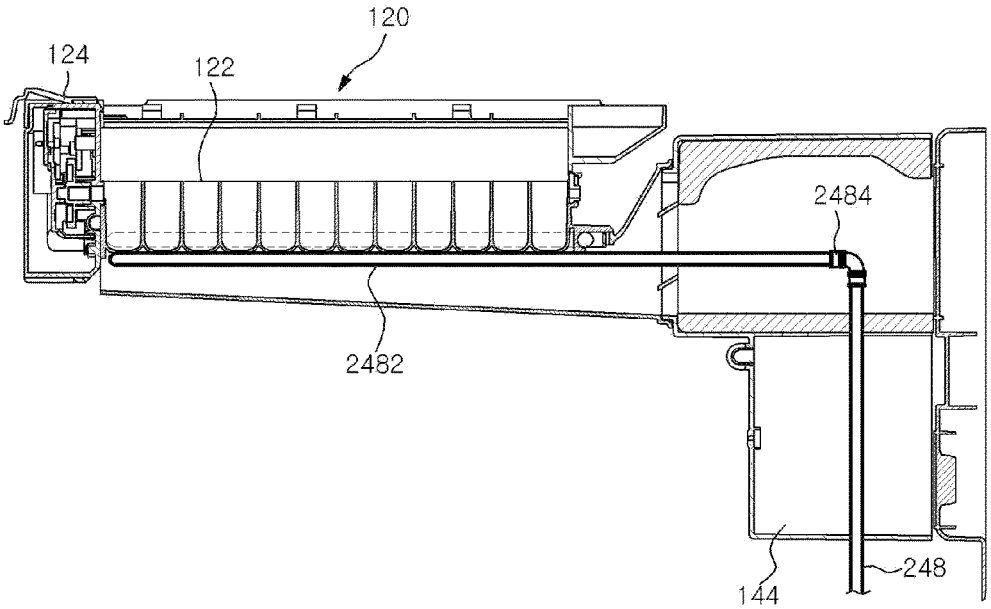
FIG. 4 is a sectional view showing a portion of the internal structure of the ice generator of FIG. 1.

Referring to FIGS. 2 to 4, the ice generator 100 may include a casing 110, an ice-making system 120, an ice bucket 130, a transfer system 140, and an outlet port 150.

A cooling space, in which ice can be generated, is defined in the casing 110. The ice-making system 120 is disposed at an upper position in the cooling space. The ice bucket 130 is disposed below the ice-making system 120.

The ice-making system 120 includes the tray 122 which provides a mold that receives water and forms ice therein, and a rotating unit 124 which rotates the tray 122 to drop ice from the tray 122 downward.

The tray 122 provides space which receives water from a water supply pipe (not shown) or the like and in which the water is cooled to form ice. In detail, the tray 122 includes, in an upper surface thereof, a plurality of forming spaces to contain water. The forming spaces can have a variety of shapes depending on shapes of ice to be produced. The number of forming spaces can also be changed.

The tray 122 is preferably made of metal, e.g., aluminum, having high thermal conductivity. As the thermal conductivity of the tray 122 is increased, a heat exchange rate between the tray 122 and the refrigerant flowing through the refrigerant pipe line can be enhanced.

The lower surface of the tray 122 comes into contact with the refrigerant pipe line 248 extending from the machinery compartment 24. A portion of the refrigerant pipe line 248 that comes into contact with the tray 122 refers to a contact part 2482. As shown in FIG. 3, the contact part 2482 may be substantially U-shaped. In detail, the contact part 2482 is extended from a first end of the tray 122, is curved by approximately 180° around a second end of the tray 122, and then is extended toward the first end of the tray 122 and connected to the machinery compartment 24.

However, this is only an illustrative example. For instance, the contact part 2482 may have a plurality of curved portions so that refrigerant can flow back and forth several times under the lower surface of the tray 122.

Here, the contact part 2482 may come into surface contact with the lower surface of the tray 122. Alternatively, to enhance heat transfer efficiency, the contact part 2482 may be firmly attached to the lower surface of the tray 122 by an adhesive, a fastener or the like.

Therefore, refrigerant that is compressed and condensed in the machinery compartment 24 is expanded by the expansion valve and thus cooled. The cooled refrigerant is transferred to the contact part 2482 of the refrigerant pipe line 248. The refrigerant transferred to the contact part 2482 cools water in the tray 122 through the contact part 2482 and the tray 122. The cooled water is phase-changed into ice.

In other words, the contact part 2482 of the refrigerant pipe line 248 functions as a small-sized evaporator of a cooling cycle.

The refrigerant pipe line 248 may include a plurality of pipes assembled together.

In a well-known fashion, the refrigerant pipes are coupled to each other by welding. Thus, there is a chance of fire during the system process. In addition, during the system process, the product may be damaged by welding heat. Furthermore, since a welding line is required, additional factory equipment is required and financial costs are increased.

To solve the above-mentioned conventional problems, in the present embodiment, the pipes constituting the refrigerant pipe line 248 are coupled to each other by a lock ring 2484 rather than by welding.

The lock ring 2484 is a coupling membrane making it possible to reliably couple (in an airtight fashion) two pipes to each other without the need of welding. When the lock ring 2484 is used, the two pipes can be coupled in an airtight fashion to each other only by force-fitting ends of the two pipes into the lock ring.

As such, the lock ring 2484 is provided on each junction of the pipes constituting the refrigerant pipe line 248. For instance, the lock ring 2484 may be provided on the junction between the refrigerant pipe line 248 and each of devices such as the compressor 242, the condenser 244, and the expansion valve (not shown) that are provided in the machinery compartment 24, whereby the pipes constituting the refrigerant pipe line 248 can be coupled in an airtight fashion to the devices provided in the machinery compartment 24.

Furthermore, the lock ring 2484 may also be provided on the junction between a substantially linear pipe and a substantially L-shaped elbow pipe, which is provided at a point at which the direction in which the refrigerant pipe line 248 extends is changed, so that the linear pipe and the substantially L-shaped elbow pipe can be coupled in an airtight fashion to each other.

Consequently, the efficiency of the process of assembling the refrigerant pipe line 248 can be enhanced. Further, during the pipe system process, there is no risk of fire or damage to the product components that is attributable to welding. Moreover, any costs associated with the procurement and maintenance of welding equipment are eliminated.

Furthermore, in the conventional refrigerator with the ice machine installed in the door, cold air is generated by heat exchange between the refrigerant and air, and the generated cold air is supplied to the tray through a cold air duct by a blower or the like. As such, in the conventional technique, an indirect cooling method using heat exchange between gas and a solid is used to produce ice. Because the efficiency of the heat exchange between gas and a solid is comparatively low, the time it takes to produce ice is increased.

However, in the present embodiment, ice is produced by a direct cooling method using heat exchange between solids, or more precisely, between the refrigerant pipe line 248 and the tray 122. Therefore, the efficiency of heat exchange is enhanced, and the time required to produce ice is markedly reduced.

The produced ice can be dropped by the rotating unit 124 into the ice bucket 130 that is disposed below the ice tray 122. In detail, when a rotating shaft (not shown) of the rotating unit 124 is rotated, the tray 122 is turned upside down such that the upper surface of the tray 122 faces the ice bucket 130. Here, when the tray 122 is rotated to a predetermined angle or more, the tray 122 is twisted by an interference membrane (not shown). Then, pieces of ice that have been in the tray 122 are dropped into the ice bucket 130 by the twisting of the tray 122.

Furthermore, a plurality of ejectors (not shown) may be provided on the rotating shaft and arranged along the length of the rotating shaft so that ice can be removed from the tray 122 by rotating only the ejectors without rotating the entire tray 122.

The transfer system 140 functions to transfer ice toward the outlet port 150 and includes an auger 142, a motor housing 144, and an auger motor 146.

The auger 142 is a rotating membrane which has a screw or a spiral blade. The auger motor 146 rotates the auger 142. The auger 142 is disposed in the ice bucket 130. Pieces of ice that are in the ice bucket 130 are disposed between portions of the blade of the auger 142 and thus can be transferred to the outlet port 150 by the rotation of the auger 142. The auger motor 146 is housed in the motor housing 144.

The outlet port 150 may be connected to a dispenser (not shown) provided in the door 20. Depending on the selection of the user, pieces of ice can be transferred by the transfer system 140 and supplied to the user via the dispenser. Although it is not shown in the drawings, a cutting unit which can cut ice into a predetermined size may be provided in the outlet port 150.

Hereinbelow, the operation and effect of the refrigerator 1 in accordance with the present embodiment having the above-mentioned construction will be described.

In the refrigerator 1 in accordance with the present embodiment, refrigerant flowing along the refrigerant pipe line 248 can be cooled while passing through the compressor, the condenser, and the expansion valve that are installed in the door 20 which is provided for closing the main body 10. The cooled refrigerant is supplied to the contact part 2482 of the refrigerant pipe line 248 that contacts the tray 122. Thus, the tray 122 is directly cooled by the refrigerant.

Water can be supplied to the tray 122 by a water supply means (not shown). Water supplied to the tray 122 is cooled by the contact part 2482 and thus changes in phase to form ice.

Here, refrigerant is moved to the contact part 2482 by compressive force provided by the compressor 242. The ice produced in the tray 122 is dropped downward by the operation of the rotating unit 124 and stored in the ice bucket 130 disposed below the tray 122.

Meanwhile, refrigerant that has been transferred to the contact part 2482 via the expansion valve and has absorbed heat from the tray 122 is transferred again to the machinery compartment 24 through the refrigerant pipe line 248. The refrigerant transferred to the machinery compartment 24 is supplied to the compressor 242 so that it can be re-cooled through a cooling cycle.

As described above, in accordance with the present embodiment, the piping structure of the refrigerator is comparatively simple. The internal capacity of the refrigerator is increased. Furthermore, efficiency in the use of energy for cooling is improved, and the time required to produce ice can be reduced.

Hereinafter, a method for manufacturing the refrigerator in accordance with the present embodiment will be described in detail.

First, the main body 10 of the refrigerator 1 is prepared, and the door 20 for closing the main body 10 is installed on the main body 10. Furthermore, the insulator 26 is installed in the internal space of the door 20. In detail, the insulator 26 is installed such that the internal space of the door 20 is partitioned by the insulator 26 into the ice compartment 22 and the machinery compartment 24.

The ice generator 100 for producing ice is installed in the ice compartment 22. The compressor 242, the condenser 244, and the expansion valve (not shown), which form a cooling cycle, are installed in the machinery compartment 24.

Furthermore, the compressor 242, the condenser 244, and the expansion valve are connected to each other by the refrigerant pipe line 248. The lock rings 2482 are used in connection with the compressor 242, the condenser 244, and the expansion valve. The multiple pipes are connected to each other to extend the refrigerant pipe line 248. In this case, lock rings 2484 are also used.

Hereinbelow, a process of assembling the refrigerant pipe line 248 using the lock rings 2484 will be described with reference to FIGS. 5 to 7.

Figure 5:
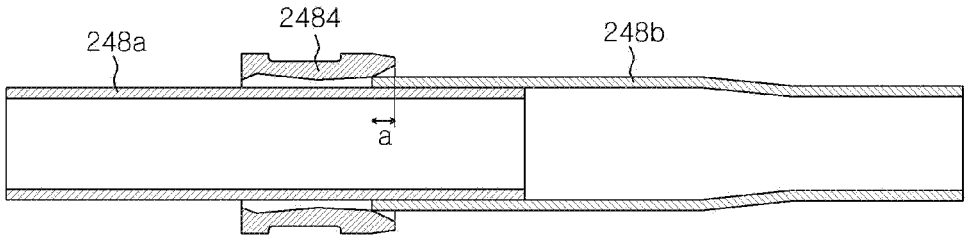
FIG. 5 is a view showing a step of a process of assembling the refrigerant pipe line of FIG. 1.
Figure 6:
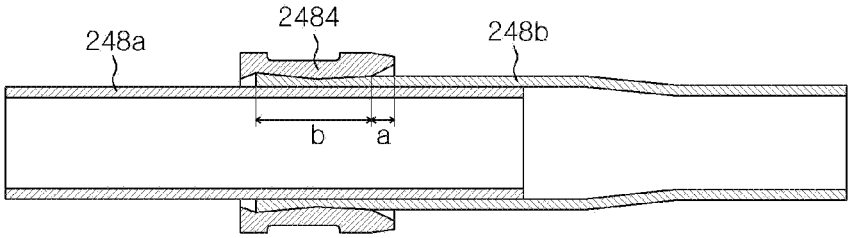
FIG. 6 is a view showing another step of a process of assembling the refrigerant pipe line of FIG. 1.
Figure 7:
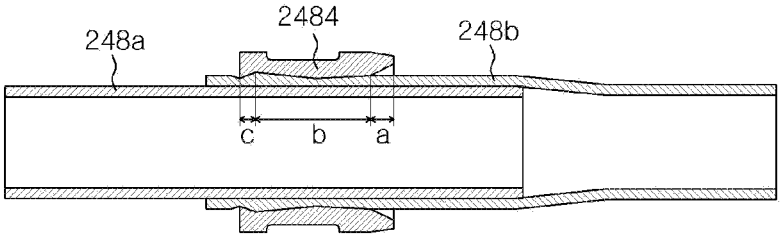
FIG. 7 is a view showing another step of a process of assembling the refrigerant pipe line of FIG. 1.

FIGS. 5 to 7 are exemplary views illustrating the process of assembling the refrigerant pipe line of FIG. 1.

Referring to FIGS. 5 to 7, the lock ring 2484 may be sectioned into three parts, that is, an introduction part a, a force-fitting part b, and a finishing part c.

The introduction part a is formed on a first end of the lock ring 2484. After one 248*a* of two pipes to be coupled to each other has been inserted into the lock ring 2484, the other pipe 248*b* is inserted into the lock ring 2484 through the introduction part a. To facilitate the insertion of the pipe 248*b* into the lock ring 2484, the introduction part a is configured to have an inclined structure such that the inner diameter thereof is reduced inward from an outer end thereof.

The force-fitting part b functions to provide a coupling force by which the two pipes can be strongly coupled to each other. For this, an inner surface of the force-fitting part b has a curved convex shape. In detail, the curved inner surface of the force-fitting part b of the lock ring 2484 applies a pushing pressure to the outer pipe 248*b*, and the inner pipe 248*a* simultaneously provides repulsive elastic force to retain the original shape thereof. Thus, the two pipes apply pressure to each other, whereby they are forcibly fitted to each other. In this way, the two pipes 248*a* and 248*b* can be reliably fastened to each other.

The finishing part c is an end of the lock ring that is opposed to the introduction part a. The finishing part c has the smallest inner diameter compared to that of the other parts of the lock ring 2484. Thus, when the two pipes 248*a* and 248*b* are connected to each other, the finishing part c functions as a sealing means. The junction between the two pipes 248*a* and 248*b* may be changed in shape by the coupling of the lock ring 2484 to the two pipes 248*a* and 248*b*. When the changed shape of the two pipes 248*a* and 248*b* is continuously maintained, the sealed state of the two pipes 248*a* and 248*b* can be retained by means of the lock ring 2484.

To couple the two pipes 248*a* and 248*b* to each other using the lock ring 2484, the inner pipe 248*a* is first inserted into the lock ring 2484, and then the outer pipe 248*b* is introduced into a space between the lock ring 2484 and the pipe 248*a* that has been inserted into the lock ring 2484. Here, the outer pipe 248*b* is inserted into the lock ring 2484 through the introduction part a of the lock ring 2484. Because of the inclined structure of the introduction part a, the outer pipe 248*b* can be easily inserted into the lock ring 2484.

After the outer pipe 248*b* has been introduced into the introduction part a, when the outer pipe 248*b* is further pushed into the lock ring 2484, the two pipes 248*a* and 248*b* are compressed and thus slightly changed in shape while the outer pipe 248*b* is inserted into the force-fitting part b. As such, when the outer pipe 248*b* is inserted into the force-fitting part b, the two pipes 248*a* and 248*b* apply pressure on each other. In this state, when the outer pipe 248*b* is further pushed into the lock ring 2484 and thus passes through the finishing part c of the lock ring 2484, the portion of the outer pipe 248*b* that is compressed by the finishing part c is reliably sealed. In this way, the two pipes 248*a* and 248*b* can be advantageously coupled in an airtight fashion to each other by force-fitting.

Through the above-mentioned process, the system of the refrigerant pipe line 248 using the lock ring 2484 can be completed.

Meanwhile, the refrigerant pipe line 248 is installed so that it connects the machinery compartment 24 to the ice compartment 22 and passes through the insulator 26.

Furthermore, the refrigerant pipe line 248 that extends to the ice compartment 22 is configured to have a substantially U-shaped curved part. For this, a substantially U-shaped pipe may be coupled by the lock ring 2484 to the pipe of the refrigerant pipe line 248 that extends to the ice compartment 22.

The substantially U-shaped pipe is the contact part 2482 described above and is installed to contact with the tray 122. Here, the contact part 2482 may be installed in such a way that the contact part 2482 is simply disposed at a position where it makes contact with the tray 122. Alternatively, the contact part 2482 may be adhered to the tray 122.

Thereafter, the casing 110 covers the ice generator 100, and the installation of the ice generator 100 is complete. Subsequently, the cover closes the portion of the door 20 that faces the main body 10, and the manufacture of the refrigerator is complete.

As described above, in accordance with the present embodiment, a piping structure is described for a refrigerator and is comparatively simple. Advantageously, the internal capacity of the refrigerator is increased, whereby efficiency in the use of space is enhanced. Furthermore, energy efficiency for cooling is improved, and the time it takes to produce ice can be reduced.

While a refrigerator in accordance with the invention have been shown and described with respect to the exemplary embodiment, the present invention is not limited thereto. It will be understood by those skilled in the art that various changes and modifications may be made without departing from the scope of the invention as defined in the following claims.

Accordingly, the scope of the present invention should be interpreted based on the following appended claims, and all technical spirits within an equivalent range thereof should be construed as being included in the scope of the present invention.

What is claimed is:

1. A refrigerator comprising:

a main body comprising a food storage space;

a door installed on the main body and configured to comprise an ice compartment and to seal the food storage space;

a compressor, a condenser, and an expansion valve, all installed in the door;

an ice generator installed in the ice compartment, the ice generator comprising a tray configured to receive and contain water;

a refrigerant pipe line configured to couple the compressor, the condenser, and the expansion valve to each other and cool the tray by conduction; and one or more lock rings configured to connect in an airtight fashion the refrigerant pipe line and at least one of the compressor, the condenser, and the expansion valve; wherein each lock ring of the lock rings comprises:

an introduction part configured wherein an inner diameter thereof is reduced inward from an outer end thereof;

a force-fitting part having a curved inner surface, wherein the curved inner surface applies a pushing pressure to the refrigerant pipe line; and a finishing part disposed on an end of the lock ring that is opposed to the introduction part, wherein the finishing part is configured to form a smallest inner diameter of the lock ring;

wherein a second pipe extending from at least one of the compressor, the condenser, and the expansion valve is inserted into the lock ring through the finishing part, wherein the refrigerant pipe line is introduced through the outer end of the introduction part into a space between the lock ring and the second pipe, wherein the second pipe provides a force against the pushing pressure so that the refrigerant pipe line and the second pipe are forcibly fitted to each other in the force-fitting part by applying pressure to each other and are sealed by the finishing part.

2. The refrigerator of claim 1, wherein the tray functions as an evaporator of a cooling cycle for producing ice in the ice generator.

3. The refrigerator of claim 1, wherein at least a portion of the refrigerant pipe line is configured to contact a lower surface of the tray.

4. The refrigerator of claim 3, wherein the portion of the refrigerant pipe line that contacts the tray is U-shaped.

5. The refrigerator of claim 1, wherein the door further comprises a machinery compartment, wherein the machinery compartment and the ice compartment are partitioned from each other by an insulator, and wherein the compressor and the condenser are disposed in the machinery compartment.

6. The refrigerator of claim 5, wherein a through hole is formed in a surface of the door that forms the machinery compartment, and wherein the machinery compartment communicates with outside the door through the through hole when the door is open.

7. A refrigerator comprising:

a main body comprising a food storage space;

a door installed on the main body and configured to comprise an ice compartment and to seal the food storage space;

a compressor, a condenser, and an expansion valve, all installed in the door;

an ice generator installed in the ice compartment, the ice generator comprising a tray configured to receive and contain water;

a refrigerant pipe configured to couple the compressor, the condenser, and the expansion valve to each other and cool the tray by conduction; and one or more lock rings configured to connect in an airtight fashion the refrigerant pipe to a second pipe extending from at least one of the compressor, the condenser, and the expansion valve; wherein each of the lock rings comprises:

an introduction part configured wherein an inner diameter thereof is reduced inward from an outer end thereof;

a force-fitting part having a curved inner surface, wherein the curved inner surface applies a pushing pressure to one of the refrigerant pipe line and the second pipe; and a finishing part disposed on an end of the lock ring that is opposed to the introduction part, wherein the finishing part is configured to form a smallest inner diameter of the lock ring;

wherein a first one of the refrigerant pipe and the second pipe is inserted into the lock ring through the finishing part, wherein a second one of the refrigerant pipe line and the second pipe is introduced through the outer end of the introduction part into a space between the lock ring and the first one, wherein the pushing pressure is applied to the second one, and wherein the first one provides a force against the pushing pressure so that the refrigerant pipe line and the second pipe are forcibly fitted to each other in the force-fitting part by applying pressure to each other and are sealed by the finishing part.

8. The refrigerator of claim 7, wherein the tray functions as an evaporator of a cooling cycle for producing ice in the ice generator.

9. The refrigerator of claim 7, wherein at least a portion of the pipe is configured to contact a lower surface of the tray.

10. The refrigerator of claim 9, wherein the portion of the pipe that contacts the tray is U-shaped.

11. The refrigerator of claim 7, wherein the door further comprises a machinery compartment, wherein the machinery compartment and the ice compartment are partitioned from each other by an insulator, and wherein the compressor and the condenser are disposed in the machinery compartment.

12. The refrigerator of claim 11, wherein a through hole is formed in a surface of the door that forms the machinery compartment, and wherein the machinery compartment communicates with outside the door through the through hole when the door is open.

* * * * *